United States Patent [19]

Otters

[11] Patent Number: 4,638,633

[45] Date of Patent: Jan. 27, 1987

[54] EXTERNAL COMBUSTION ENGINES

[76] Inventor: John L. Otters, 11317 Miller Rd., Whittier, Calif. 90604

[21] Appl. No.: 790,039

[22] Filed: Oct. 22, 1985

[51] Int. Cl.[4] ..... F02G 1/04; F02G 1/06

[52] U.S. Cl. ..... 60/518; 60/520; 60/525; 60/517

[58] Field of Search ..... 60/517, 518, 520, 525, 60/526; 62/6

[56] References Cited

U.S. PATENT DOCUMENTS 4,434,617 3/1984 Walsh ..... 60/520

4,489,554 12/1984 Otters ..... 60/520

*Primary Examiner*—Allen M. Ostrager

*Attorney, Agent, or Firm*—Beehler, Pavitt, Siegemund, Jagger, Martella & Dawes

[57] ABSTRACT

A Stirling type thermal engine is disclosed in which the engine is sealed within an outer shell enclosure which maintains the engine components in an axially compressed state to thereby simplifying construction of the engine while maintaining a sealed atmosphere of working fluid about the engine thereby minimizing leakage seal problems and also providing a containment enclosure about the engine in the event of explosive failure of the same.

33 Claims, 12 Drawing Figures

16
44
48
52
17
20
28
26
24
24a
58
34
96
10
14
25
68
70b
70a
62a
32
64
30
24
24b
74a
36c
74b
36a
36
22
19
85
90
38
84a
60
84
12
80
37
76
82
76
72
35
86
88
94
92
98
36b
66
40
96a
39
62b
18
42
56
46
50
100
102
78
79

134
136
132
126
138
140
141
142
48'
128
55
130
168
124
166
55
162
152
14
160
154
34
164
24
55
30
68
156
70b
32
64
70a
62a
96
76
12
74b
146
123
36a
144
37a
37b
35
122
38
36
98
36c
118
120
94
36d
60
185
14
40
96a
78
66
18
56
62b
79
42
50
102
100

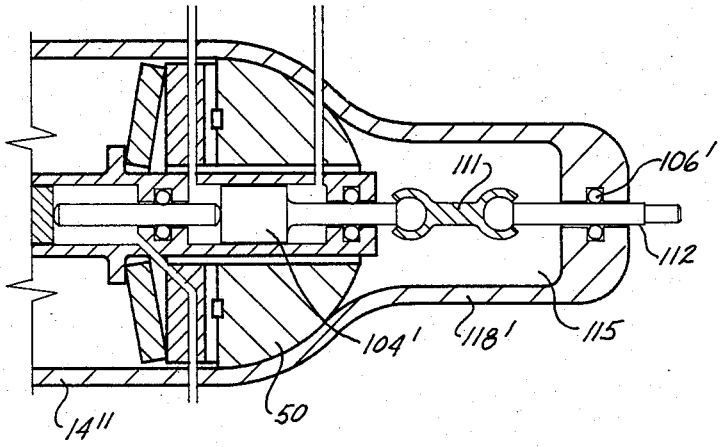
FIG 5C
FIG 5a
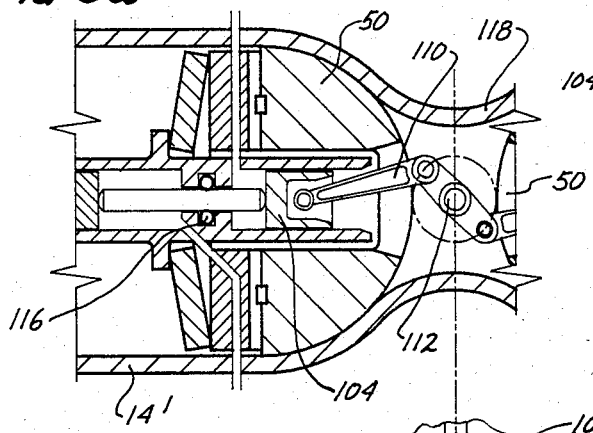
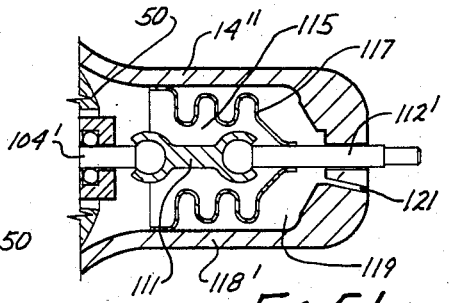
FIG 5d
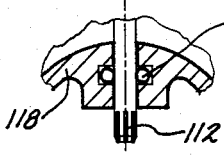
FIG 5b
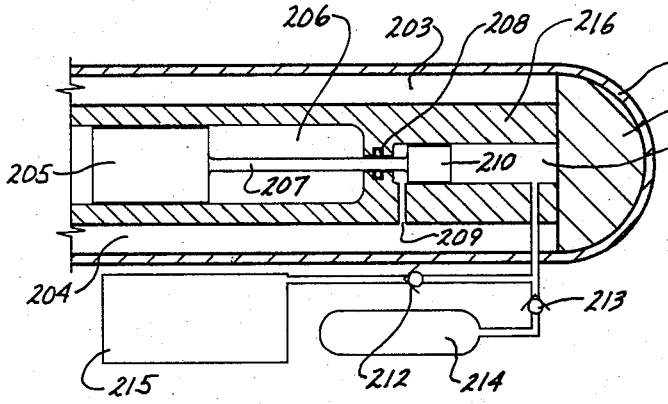
FIG 6

EXTERNAL COMBUSTION ENGINES

BACKGROUND OF THE INVENTION

1. Field of the Invention

The present invention relates generally to the field of Stirling or similar cycle thermal machines and is more particularly directed to a thermal machine sealed within an outer shell enclosure which maintains the engine components in an axially compressed state to thereby simplify construction of the engine while maintaining a sealed atmosphere of working fluid about the engine thereby minimizing leakage seal problems and also providing a containment enclosure about the engine in the event of explosive failure of the same.

2. State of the Prior Art

The present invention is generally directed to thermal machines of the general type wherein a working fluid is subjected to a thermodynamic cycle within a chamber by reciprocating a displacer body within the chamber for displacing the working fluid between a hot and a cold space in the chamber. In the case of an engine a heat input is provided and the resulting cyclic variations in working fluid pressure may drive a work piston so as to derive a work output. Conversely, a work input may reciprocate a compressor piston so as to alternately compress and expand the working fluid. The resulting cyclic variations in working fluid temperature are used in a refrigerator for cooling one end of the working fluid chamber in a manner well known in the art.

In either cae, the working fliuid is usually contained at a relatively high pressure and presents problems in terms of leakage both around the work piston through the dynamic seal between such piston and its cylinder wall, and also through various joints and connections in the machine housing to the outer atmosphere. The control of such leaks, particularly in cases where the working fluid is flammable, such as hydrogen, has been a source of continuing difficulty to which many solutions have been proposed.

The thermodyamic efficiency of such thermal machines is dependent in part on the mean pressure of the working gas and on the temperature differential between the hot and cold spaces of the displacer chamber. In an engine, greater efficiency can be obtained by supercharging the displacer chamber with working gas at very high pressures and then operating the engine at the greatest possible temperature differential between the hot and cold ends of the displacer chamber, thus heating the already highly pressurized working gas to very high temperatures. In practice however, the maximum safe operating pressures and temperatures of Stirling and similar engines are limited by the physical properties of the materials used in constructing the engine and on the construction and assembly techniques used.

Stirling cycle and similar machines are often designed along a main axis extending between a thermal end which receives the heat input and opposite work end at which work is either delivered in an engine or applied in the case of a refrigerator. Temperatures of engine components vary greatly at different points along this main axis, typically reaching extremes at the thermal end and graduating to near ambient temperature at the work end.

The bodies or housings of such machines are typically assembled in several axial body sections which are secured to one another by means of radial flanges on each body section. The flanges are bolted, screwed or clamped together to hold the various sections against the internal operating pressures of the machine and in combination with sealing rings or gaskets to make high pressure gas tight seals where needed to contain any pressurized fluids within the machine. Greater working fluid pressure require increasingly heavy cylinder walls at the same time that the strength of the engine body material is degraded as operating temperatures are increased. Metal alloys conventionally used in making machine body sections thus set upper limits to the working fluid pressures and temperatures which fall short of the operating parameters desirable for optimum machine efficiency.

Recent advances in material technology have produced new categories of materials, particularly ceramics, capable of withstanding substantially higher temperatures and pressures than metallic alloys normally used for engine components. While it would be advantageous to incorporate ceramic parts into thermal machines and particularly into external combustion engines in cases where operating temperatures exceed 1,100 degrees Centigrade (approximately 2,000 F.), difficulties exist in assembling a hybrid engine comprising both ceramic and metallic parts due to their dissimilar mechanical characteristics, particularly their varying coefficients of thermal expansion. In external combustion engines for example, it has been found advantageous to use ceramic material such as silicon carbide for the engine heater head while retaining metallic materials for the cooler sections of the engine. Ceramic materials while able to withstand substantial pressures, are more brittle than metallic components and thus do not flex readily under the compound stresses frequently imposed by fasteners, e.g. bolts, tie-rods, etc., normally used to assemble the axial sections comprising the machine body. The use of brittle materials for the heater head is complicated not only by the different mechanical properties at high temperatures, but also because the ceramic material is limited in the amount of working fluid pressure which it will safely tolerate due to its brittleness, particularly at high temperatures. Further, the physical properties of ceramic materials are less uniform and predictable than those of metallic alloys and the use of ceramics therefore calls for higher design safety margins. Even where the machine body sections are made of similar materials, e.g. all steel bodies, conventional assembly techniques call for relatively massive radial flanges on each body section which are bolted or clamped together. As operating pressures and temperatures are increased these flanges as well as the cylinder walls of the machine body must be made increasingly heavy, practical considerations ultimately limiting the maximum safe operating pressures and temperatures.

Another problem area in Stirling cycle machines has been adequate control over leakage of the pressurized working fluid. The working fluid is contained in a displacer chamber where it is subjected to a thermodynamic cycle with consequent expansion and contraction of the working fluid. The cyclical variations in working fluid pressure drive a work piston from which a work output is derived. In many previous engine designs, fluid leakage around the work piston has been a continuing source of difficulty, both in terms of contamination of the working fluid by extraneous fluids (e.g. hydraulic fluid pumped by the work piston) and also loss of pressurized working fluid through leakage around the work piston. One solution to this problem has been proposed by this applicant in U.S. Pat. No. 4,489,554, consisting of a compound work piston where two piston elements are connected by an axial, small diameter linkage which is easier to seal than the larger diameter piston and which may also form part of a pumping arrangement designed to recover leaking working fluid, either by returning the same to the displacer chamber or by feeding it to the engine burner for combustion.

Further improvement of Stirling cycle and similar machines is needed to overcome the aforementioned difficulties.

SUMMARY OF THE INVENTION

The present invention seeks to overcome these and other shortcomings of the prior art by providing a hermetically sealed outer shell or vessel fully enclosing the thermal machine, which may be configured as either an engine or refrigerator.

The outer shell may be tubular and closed at two opposite shell ends, the central longitudinal axis of the shell being aligned with the axis of the thermal machine such that the two axial ends of the machine body are maintained in compression between the two shell ends. The outer shell is dimensioned and constructed for maintaining the thermal machine body in a normal state of axial compression along the main longitudinal axis of the machine body in cooperation with a pre-loading device. Thus a machine body consisting of several distinct axial elements or sections can be held together axially by nothing more than the compressive force exerted thereon, advantageously replacing the flange-and-fastener approach presently required to interconnect the various axial components of such a machine body. The outer shell is maintained in a normal state of tension relative to the machine body either by one or more pre-loading devices axially interposed in compression between the machine body and the outer shell, thereby maintaining the machine body in axial compression. In the alternative the outer shell may be appropriately undersized axially relative to the machine body so as to stretch the shell axially between the machine body ends. The tensile force on the outer shell is desirably transmitted through a spherical aligner interposed between the shell and the machine body at each end of the shell so as to compensate for possible deviations in the axial alignment of the machine body sections thereby to maintain the outer shell in pure axial tension notwithstanding inaccuracies in the axial alignment of the machine body sections.

The present invention eliminates the use of fasteners particularly for axially interconnectiong machine body sections of dissimilar or similar materials, as for example attaching a ceramic hot head to metallic machine body portions. At the same time, the resistance of the ceramic elements to high internal pressure at temperature extremes is increased by maintaining the ceramic material in axial compression without being subjected to the compound stresses which would be imposed on the ceramic sections if conventional flanges and fasteners were used.

Bolted flanges have a tendency to exert compound stresses on the machine body components which are poorly tolerated by ceramic or similarly brittle material. The use of an outer shell makes possible the application of axial or column loading on the various machine body sections so as to form high pressure seals between the machine body sections regardless of similarity of material. For example, a brittle ceramic hot end of an engine can be axially compressed against axially adjacent body sections to maintain the high pressure seal necessary to contain highly pressurized working fluid and in fact thereby increasing the brittle ceramic material's resistance to high internal engine pressure.

The outer sheel is further useful as a containment vessel and physical shield for protection against possible explosive failure of a machine operated at pressure and temperature limits in excess of those considered safe in current machine designs. By dimensioning the outer shell so that its inner volume is substantially greater than the volume occupied therein by the machine body, a buffer space may be defined between the outer shell and the machine body which desirably is substantially greater than the volume of compressed working fluid contained in the machine body so as to allow decompression of pressurized gases released into the buffer space upon explosive failure of the machine body to a pressure level which can be contained by the shell wall.

The outer shell of this invention facilitates use of ceramic body elements thus allowing operation of the machine along a thermodynamic cycle extending between greater temperature extremes, while the containment and shielding functions of the outer shell permit increased operating pressures, thereby improving thermodynamic cycle efficiency.

Still further, the outer shell permits the operation of the thermal machine in a closed atmosphere of working fluid, whereby a common gas is maintained throughout the system, both inside and outside the body of the thermal machine, thus greatly alleviating the problem of leakage of working gas to the atmosphere or contamination of the working fluid with air. The requirements imposed on the gas seals internal to the machine body are greatly reduced since a moderate amount of working fluid leakage from the machine into the surrounding buffer space defined by the outer shell may be tolerated and the leaking fluid returned to the machine or a storage container by means of suitable pumps, or in the alternative may be disposed of by combustion in an engine burner. The working gas atmosphere in the buffer space contained by the outer shell is preferably maintained at only slightly above atmospheric pressure to minimize the sealing requirements between the shell and the outer environment, particularly for mechanical shafts passing through the outer shell wall and also to prevent flow of air into the shell through such sealed shaft openings.

As will be apparent from the various examples in the following detailed description, the multiple benefits derived from use of an outer shell or containment vessel according to this invention facilitate and simplify the design and construction of the thermal machine while at the same time permitting the use of materials for machine body components having advantageous properties but which have been found difficult to assemble into conventional thermal machine construction, minimizes working fluid sealing problems, and provides a safety shield which allows operation of the machine at higher pressures and temperatures for improved thermodynamic efficiency.

This applicant is not aware of existing thermal machine designs which include an outer shell for the purposes described herein, and in particular does not believe it known to provide such an enclosure with spherical aligners at each end for maintaining the shell in axially aligned tension.

These and other advantages of the present invention will be better understood by reference to the accompanying drawings taken in light of the following detailed description of the preferred embodiments.

BRIEF DESCRIPTION OF THE DRAWINGS

FIG. 5*a* is a fragmentary longitudinal section showing a mechanical crankshaft output arrangement for an engine enclosed in an outer shell according to this invention.

FIG. 5*b* is a fragmentary longitudinal section showing the seal between the output shaft and the outer shell in FIG. 5*a*.

FIG. 5*c* is a fragmentary longitudinal section showing the sealing of an axially reciprocating output shaft.

FIG. 5*d* shows a bellows seal for a linearly reciprocating output shaft.

FIG. 6 shows in fragmentary longitudinal section the work output end of an engine constructed as a gas compressor for compressing a gas similar to the working gas used by the engine.

DETAILED DESCRIPTION OF THE PREFERRED EMBODIMENTS

Figure 1:
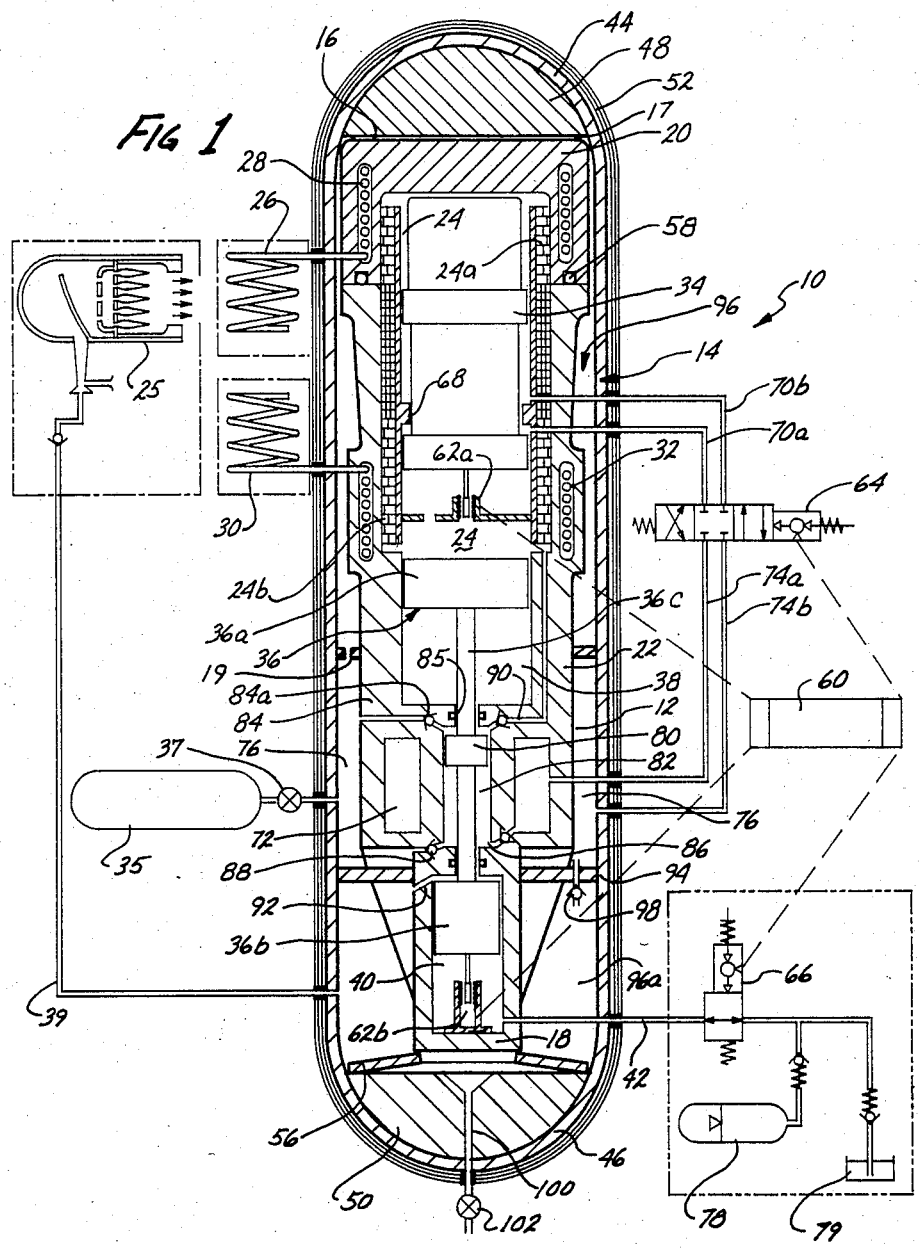
FIG. 1 is a longitudinal section of a Stirling engine constructed according to this invention characterized by a heat source external to the outer shell and a hydraulic output.

With reference to the drawings, FIG. 1 shows an improved thermal machine 10 comprising a Stirling cycle engine 12 enclosed within an outer shell 14. The engine 12 is arranged along a main engine axis extending between a hot thermal end 16 and an opposite work output end 18. The body of engine 12 comprises a heater head section 20 made of a ceramic such as Silicon Carbide and a metallic body section 22 constituting the remainder of the engine body. A displacer chamber 24 is partly defined by the ceramic head 20 and partly by the metallic portion 22 and is filled with a suitable working fluid such as hydrogen or helium gas. The hot and cold spaces of the displacer chamber 24 are provided with heat exchangers 24*a* and 24*b* respectively and a regenerator 25 connecting the hot and cold ends of said chamber. The heater head 20 is heated as by sodium vapor supplied by heat pipe 26 to engine heater coil 28. The heat input to the engine 12 is provided by a gas burner 25 external to the outer shell 14. The cold end of the displacer chamber 24 is cooled by a suitable fluid such as ammonia supplied to coiling coil 32 by heat pipe 30. The working fluid within the displacer chamber is subjected to a thermodynamic cycle by being displaced between the hot and cold ends of the displacer chamber in response to reciprocating movement of displacer 34. The resulting cyclic variations in working fluid pressure drive a compound work piston 36 against a gas spring 38. In the illustrated embodiment, the compound work piston includes a first piston element 36*a* driven by the working fluid and a second piston element 36*b* connected by a relatively small diameter axial rod or linkage 36*c* to the element 36*a*. The element 36*b* pumps a hydraulic fluid in chamber 40 through an output line 42.

Figure 3:
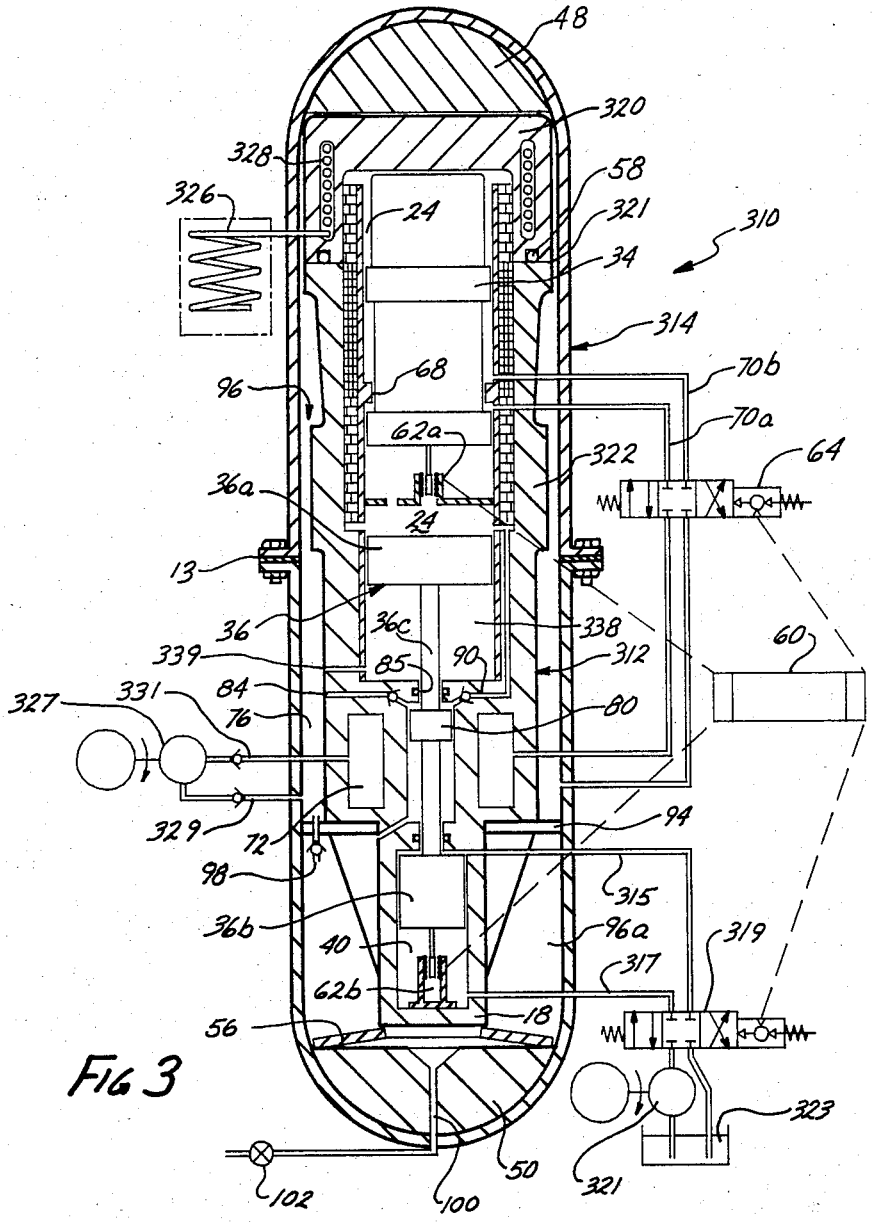
FIG. 3 is a longitudinal section of a Stirling cycle refrigerator according to this invention.

The outer shell 14 is cylindrical in cross-section and is terminated by an upper hemispherical end portion 44 and lower hemispherical end portion 46. The shell may be made in two halves joined at the midline of the shell cylinder as shown in FIG. 3 by means of flanges 13 bolted, screwed or clamped together as in conventional high pressure vessel construction, particularly autoclave vessels. In small units it may be desirable to weld the two shell halves together to make a sealed vessel which can be readily cut open at the weld line if repairs to the machine enclosed therein become necessary. The shell may be made of metal such as high strength steel, high strength aluminum, or mild steel, or in the alternative plastic or composite materials may be used. The shell halves may be made by casting, forging, or deep drawing methods, or may be fabricated from rolled sheet metal welded to pressure formed end caps. The outer shell or envelope 14 may be reinforced by winding a continuous high strength glass or carbon fiber filament either circumferentially, longitudinally or both to make an outer filament layer 52 over the hermetically sealed wall of the shell 14, thereby to put the shell 14 in compression according to the direction of the filament winding.

Interposed between the hemispherical end portions of the outer shell and the corresponding end of the engine body are two spherical aligners 48 and 50. Each aligner is shown as a solid hemispherical body, although it may be partially hollowed out for weight savings, and having a smooth outer spherically curved surface and a plane circular inner surface. The outwardly facing spherical surfaces of the two aligners fit closely within and are slideable against the spherically concave inner end surfaces of the outer shell 14.

The upper spherical aligner 48 has a planar inner face acting against the flat upper end 16 of the ceramic heater head 20 through a zirconia ceramic flat pad insulator 17. The lower end 18 of the engine is supported by a Belleville type pre-loading spring 56 compressed between the engine end 18 and the spherical aligner 50 for compressively loading the engine body assembly between the two spherical aligners 48 and 50. The preloading spring is selected to apply a compressive force to the machine body substantially in excess of the maximum internal operating pressures in the engine body 12 acting to axially separate the body sections 20 and 22 so as to maintain the engine body 12 under axial compression at all times and assure the integrity of the gas seal 58 against internal operating pressures. In the event of axial misalignment of the various engine body sections causing the longitudinal axis of the engine 12 to move out of alignment with the central longitudinal axis of the outer shell 14, one or both of the spherical aligners 48 and 50 are able to rotate against their corresponding spherical end cap 44, 46 so as to maintain alignment of the compressive force along the central axis of the outer shell 14 and prevent imposition of a bending moment on the outer shell resulting from such misalignment. Vertical alignment of the engine body may further be assured against lateral buckling due to the axial loading of the engine body by provision of a transverse support 19 connecting the engine body to the wall of the outer shell at a longitudinally intermediate point thereof. The support is perforated or apertured for allowing free flow of gas therethrough.

This outer shell arrangement maintains the ceramic head 20 in axial compression against the metallic engine block section 22 while the outer shell is in axial tension between the two spherical aligners under the loading of spring 56. A gas tight seal for containing the pressurized working gas in displacer chamber 24 is maintained between the ceramic head 20 and engine block 22 by providing a static seal ring 58 set into a circular groove formed in one or both of the ceramic head 20 and the upper end of the metallic engine block 22. The seal is maintained only by the axial compressive force acting on the engine body sections and no other fastener is used to hold together the engine body sections nor to maintain the seal between the ceramic head and metallic engine block. In certain cases, such as small engine or machine bodies a gas tight seal can be secured by merely lapping flat the mating surfaces of the axially adjacent body sections which are then held tightly against each other by the force of the pre-loading spring 56. It is desirable in any case to provide locating rings (not shown) set in aligned grooves in the mating surfaces or similar means for holding the adjacent engine body sections in radial alignment and against radial shifting relative to each other. It is understood that the engine body and particularly section 22 thereof may consist of a greater number of discrete axial sections held together axially by the force applied by pre-loading spring 56 relative to the tensed outer shell 14.

As the engine is charged with pressurized working fluid followed initial assembly, and as the working fluid and engine components are heated during engine operation, misalignments of the axial engine geometry resulting from thermal expansion are accommodated by movement of the spherical aligners.

In a practical engine constructed according to this invention, the body of engine 12 would be surrounded by layers of heat insulating material (not shown in the drawings) and the diameter of the outer shell 14 is desirably sized so as to enclose a volume greater than the volume occupied therein by the actual engine 12. This provides a buffer space 96 sufficient to allow decompression of explosively released working gas to a pressure which can be contained by the wall of the outer shell 14. Thus the shell 14 not only is intended to contain flying fragments resulting from catastrophic failure of the engine, but to also contain explosive release of gas resulting from failure of any part of the engine 12.

The top of the hydraulic fluid chamber 40 is vented to the low pressure buffer space by passage 92 and the buffer space enclosed by the outer shell 14 is divided by a transverse bulkhead 94 into a lower buffer space **96*a* and an upper buffer space 76. The lower space 96*a* is isolated by the bulkhead 94 and a pressure equalizing anticontamination check valve 98 to prevent contamination of the upper space 76 due to possible out-gassing from the hydraulic fluid in chamber 40 into the lower buffer space. Any leakage of hydraulic fluid through passage 92 from the engine into the lower buffer space 96*a* is drained through a drain conduit 100 provided with a drain valve 102 and extending through the lower spherical aligner 50 and through a pressure seal in shell 14**.

The engine cycle is controlled by means of engine controller 60 which receives input information derived from position sensors such as LVDT position sensors **62*a* and 62*b*. The input information is indicative respectively of the position of the displacer 34 and piston 36 along their respective strokes. The engine controller 60 derives an output control signal based on said input information which controls a four-way servo valve 64 and a two-way servo valve 66. The valve 64 pneumatically controls the motion of the displacer 34 by applying a controlled pressure differential across a dynamic seal 68 through pneumatic lines 70*a* and 70*b*. The pneumatic displacer drive is supplied with high pressure gas through supply line 74*a* from an annular gas storage reservoir 72 defined in the engine body section 22 while a pressure sink is obtained through return line 74*b* connected to the sealed buffer space 96 defined between the outer shell 14 and the engine 12**, and which is filled with working gas at atmospheric or preferably somewhat above atmospheric pressure.

The engine controller 60 controls the direction and magnitude of the presssure differential between the pneumatic control lines **70*a* and 70*b* through the servo valve 64 to maintain positive control over the motion of displacer 34. The engine controller 60 also controls servo valve 66 which controls the volume of hydraulic fluid flow into and out of piston chamber 40 through conduit 42, i.e. both outflow to hydraulic pressure accumulator 78 and inflow from hydraulic fluid reservoir 79. The motion of the compound work piston 36 is thus likewise under positive control independently of the displacer 34** and therefore the phase relationship between the displacer and compound work piston can be adjusted to obtain a desired engine cycle. For a more detailed description of such an engine control system reference is made to U.S. Pat. No. 4,489,554 issued to this applicant.

In a pneumatic engine control system such as this, it is advantageous to maintain the highest possible working fluid mean pressure in displacer chamber 24 so as to increase the stiffness of the working gas and thereby maintain more accurate control over the displacer. This objective is in accord with the aforementioned desirability of operating such engines at high working fluid pressures for improved thermodynamic efficiency. However, higher working fluid pressures also increase the risk of explosive failure of the engine body, particularly where brittle ceramic components are used. This hazard is safeguarded against by the outer shell 14 which forms both a decompression buffer space 96 and presents a physical barrier against flying fragments. Provision of such buffer space not only eliminates or greatly diminishes the usual problems of sealing two gases against each other, such as highly pressurized hydrogen working gas v. atmospheric air, but also provides a reservoir for containing working gas leaking out of the displacer chamber 24 and which can then be repressurized for use in the pneumatic control system or returned to the displacer chamber 24. This is achieved by a an internal gas pump arrangement comprising a gas pump piston 80 affixed on work piston linkage rod **36*c* of the compound work piston 36 and which reciprocates within a pump chamber 82 sealed at each end by dynamic seals 85**. On the down stroke of the work piston 36 gas is drawn from the low pressure buffer space 76 through intake conduit 84 and check valve 84*a*, while gas present in the pump chamber 82 below piston 80 is pumped through outlet conduit 86 into the high pressure gas storage chamber 72 for use in the pneumatic control system. On the up stroke of the pump piston 80, gas is drawn from the low pressure buffer space 72 through inlet conduit 88 while gas present in the pump chamber 82 above the piston 80 is pumped through outlet conduit 90 into the displacer chamber 24, thereby maintaining working fluid pressure there. A working gas supply tank 35 connected through pressure regulating valve 37 to the upper buffer space 76 provides the working gas necessary to run the entire system, supplying gas as fuel to the engine burner 25 through check valve 98 in the transverse baffle 94 and burner supply line 39 connected to the lower buffer space 96*a*.

It will be appreciated that provision of the outer shell 14 thus permits operation of the engine 12, including a working gas leakage control system and a pneumatic engine control, as a closed system sealed against loss of working fluid to the outer environment.

Figure 2:
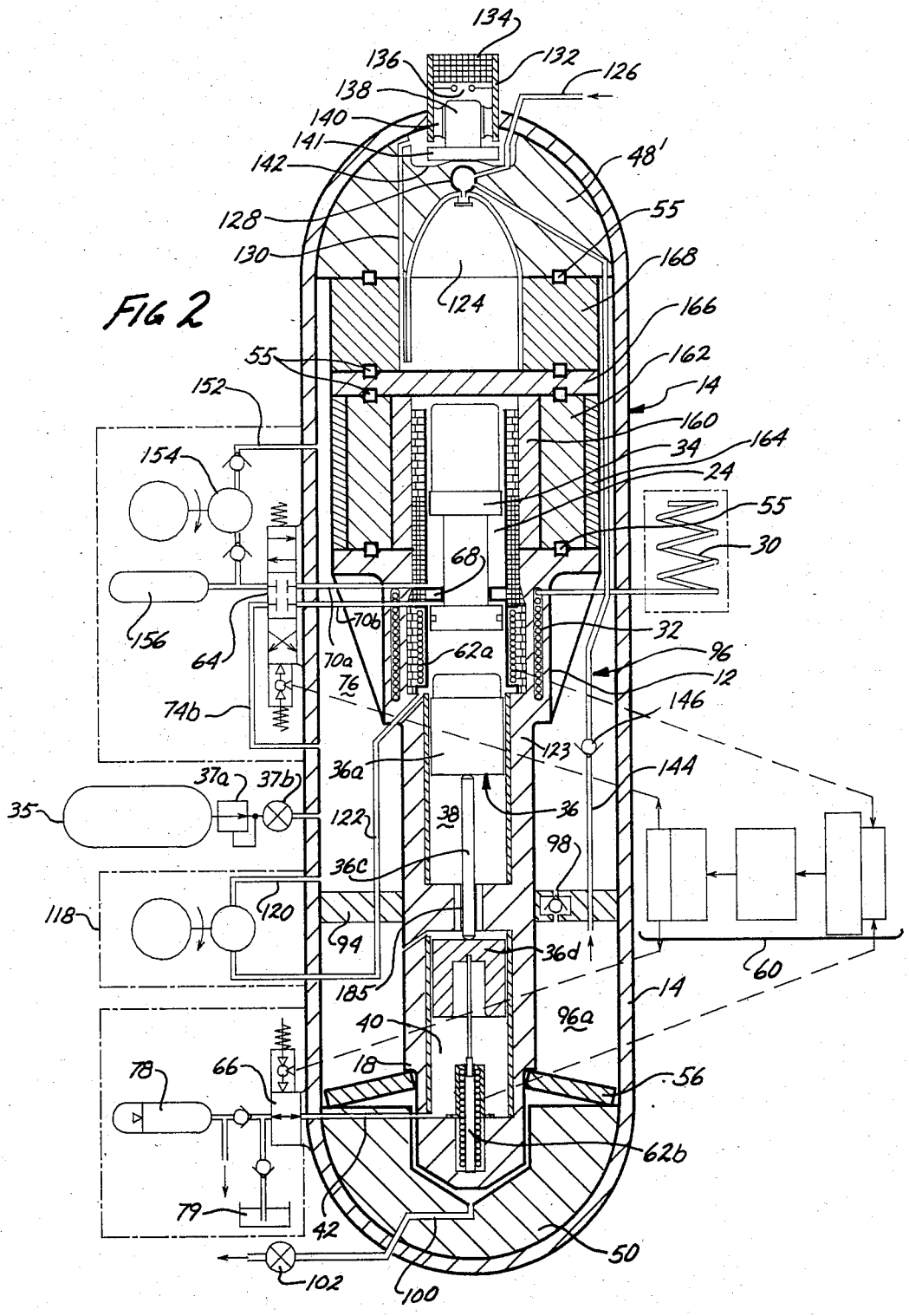
FIG. 2 is a longitudinal section of a second embodiment of the novel Stirling engine powered by a gas burner internal to the engine's outer shell.

The engine of FIG. 2 differs in several respects from the embodiment of FIG. 1, but like elements bear like numbers. A first difference is the use of an external motor driven gas pump 118 for pressurizing working gas drawn from the low pressure upper buffer space through intake conduit 120 and returned to the displacer chamber by way of conduit 122. The motor driven pump 118 replaces the use of the pump piston 80 and associated components in FIG. 1.

Secondly, the FIG. 2 embodiment includes a gas combustor 124 internal to the outer shell 14 which is fed by a gas-air mixture consisting of atmospheric air drawn through intake conduit 126, mixed with combustible gas in mixing chamber 128, and then burned in combustion chamber 124. Exhaust gases produced by combustion are discharged through conduit 130 from the combustion chamber and vented to the atmosphere through an exhaust pipe 132 provided with a flame arrester 134 and leakage gas igniter 136. An anti-detonation valve 138 consists of a slideable plunger provided with a closure element 141 dimensioned to cover and close the vent passages 140, but which is in the normally open position shown in FIG. 2 allowing free out-flow of exhaust gases through the vent pipe 132. In the event that structural failure of the engine 12 or a detonation in the combustor chamber 124 releases pressurized gas into the buffer space, the high pressure front of suddenly released gas operates to push up and close the anti-detonation valve 138 so as to close the vent openings 140 with the enlarged bottom portion of the anti-detonation valve 138.

The gas fuel for the engine combustor 124 may be conveniently drawn from the low pressure lower buffer space 96*a* itself in those cases where the working fluid is combustible, as for example in the case of hydrogen gas. Thus, working gas lost from the displacer chamber through leakage into the buffer space 76 through any leak path in the engine can be recovered either for return to the displacer chamber and/or for use in fueling the engine combustor 124. In particular, in an engine provided with a transverse bulkhead 94 gas from the upper low pressure buffer chamber 76 may be compressed and returned to the displacer chamber while potentially contaminated gas from the lower low pressure buffer space 96*a* may be fed to the combustor chamber 124 through a conduit 144 provided with an anti-flashback check valve 146 and connected to mixing chamber 128.

A working gas supply tank 35 similar to that of FIG. 1 is connected through pressure regulator 37*a* and valve 37*b* to the upper buffer space 76, and supplies working gas to the engine burner 124 through pressure equalizing valve 98 and lower buffer space 96*a*, then through combustor supply line 144 connected to mixing chamber 128. The working gas supply tank 35 also feeds the upper buffer space 76 from where working gas is drawn by conduit 152, pressurized by a motor driven pump 154 external to the outer shell 14 and stored in pressure vessel 156 for use in the pneumatic displacer drive and control system which includes four-way pneumatic valve 64 controlled by an output control signal derived by engine controller 60 as has been explained in connection with FIG. 1 for applying a controlled pressure differential across dynamic seal 68 by means of pneumatic lines 70*a* and 70*b*. The compound work piston 36 in FIG. 2 lacks the gas pump piston 80 and associated gas pump of FIG. 1 which has been replaced by external gas pump 154 powering the pneumatic displacer control system, and by external gas pump 118 for repressurizing the displacer chamber 24 with working gas drawn from upper buffer space 76 so as to make-up for leakage around the work piston element 36*a* and high pressure seal 185 or through other leakage paths.

In the engine of FIG. 2, a more complex and realistic hot end insulating assembly is shown consisting of a number of separate insulating elements of ceramic or equivalent material, as for example a cylindrical silicon carbide inner liner 160 surrounded by a high pressure insulating ring 162 of e.g. zirconia ceramic. Both ceramic rings 160 and 162 are held in radial compression by means of an outer compression ring 164 made of, e.g., high strength steel shrink-fit over insulating ring 162. The use of the compression ring 164 places the inner ceramic rings 160 and 162 under both radial as well as axial compression, thereby increasing the upper pressure limit at which the working gas may be safely operated in the displacer chamber 24. The three concentric rings 160, 162 and 164 comprise an engine body section held in axial compression between a transverse heater plate 166 and the upper end of the lower porltion 123 of the engine body. The heater plate 166 may be of a heat conducting ceramic material such as silicon carbide formed with finned upper and lower surfaces for optimum heat exchanging characteristics. The upper surface of the plate 166 is heated by the burner 124 and the heat is transfered through the plate to the gas in the upper or hot end of the displacer chamber 24. The burner 124 is surrounded by an insulating rinfg 168 of a suitable material such as zirconia ceramic. It will be appreciated thus that the body of the engine in FIG. 2 is comprised of a number of axially assembled sections consisting of burner insulating ring 168, heater plate 166, displacer chamber insulation ring assembly including rings 160, 162 and 164, and the lower portion 123 of the engine body which includes the work piston assembly. The several engine body sections are held axially together only by the pre-loading spring 56 acting against the outer shell 14 through the spherical aligners 48′ and 50. Locating rings 55 are provided in grooves formed in the mating surfaces of adjacent engine body section for fixing the sections against relative radial displacement. The locating rings 55 may be conventional locating rings fitted into grooves in the mating surfaces or such rings may be machined integrally in the mating surfaces. No other fasteners however are used nor required to maintain the various body sections in axially assembled relationship. Minor leakage of working gas between the mating surfaces of the various body sections is easily tolerated since the escaping gas flows into the buffer space enclosed by the outer shell 14 and not into the atmosphere, particularly since the system is provided with a pumping arrangement for repressurizing working gas drawn from the low pressure buffer space and replenishing the displacer chamber with pressurized working gas.

Figure 4A:
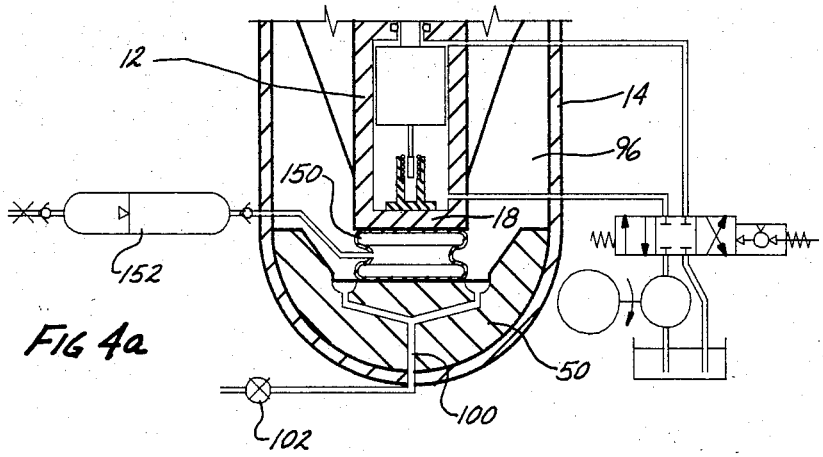
FIG. 4*a* is a fragmentary longitudinal section of a thermal machine showing use of a hydraulic pressure accumulator connected to a bellows for compressively pre-loading the machine body.
Figure 4B:
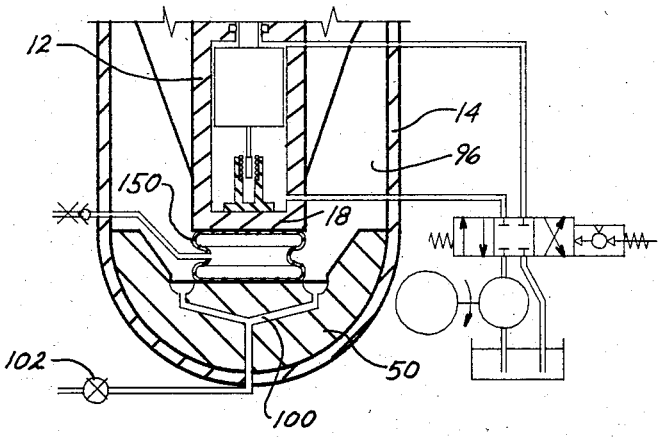
FIG. 4*b* is a fragmentary longitudinal section of a thermal machine showing use of a bellows filled with pressurized compressible fluid for compressively pre-loading the machine body.
Figure 4C:
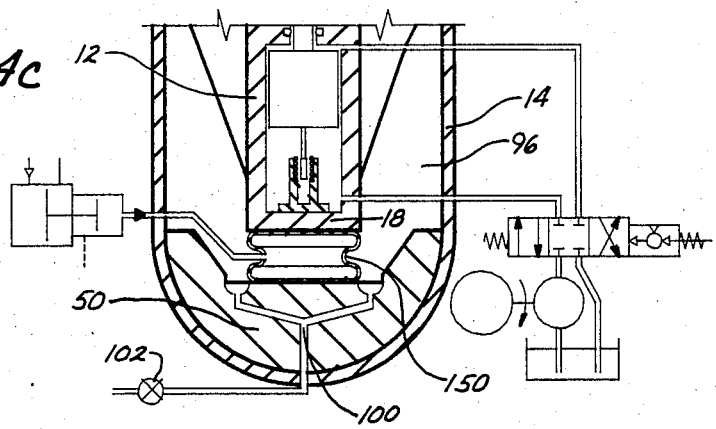
FIG. 4*c* is a partial longitudinal section of a thermal machine showing use of a pressure compensator unit charging a bellows for compressively pre-loading the machine body.

The pre-loading spring 56 is shown in both FIGS. 1 and 2 as a mechanical spring, specifically as a single or stacked Belleville washer arrangement. The pre-loading spring 56 may however take many other forms. For example, in FIGS. 4*a* through 4*c*, the Bellville spring 56 has been replaced by a bellows 150 interposed between the lower end 18 of a thermal machine 12 and lower spherical aligner 50 and expandable along the main engine axis. The bellows 150 may be pressurized by any suitable means, including the use of a hydraulic fluid accumulator 152 as a pressure source in FIG. 4*a*, by a charge of compressible liquid such as a compressible silicone based oil or by gas charge maintained at a sufficient pressure as in FIG. 4*b* or by use of an air-hydraulic intensifier connected to the bellows as in FIG. 4*c*, so as to provide the axial spring loading of the engine body assembly and thus maintain the outer shell 14 in tension while the thermal machine 12 is maintained in axial compression. FIGS. 4*a*–4*c* show only the lower or work input portion of a thermal machine configured as a refrigerator with a work piston driven by a hydraulic input similar to the refrigerator of FIG. 3.

FIG. 5*a* illustrates a thermal machine comprising two engines each having a compound work piston 104 and driving a common crank shaft 112. The two engines are mounted end-to-end in axially opposing relationship within a single modified outer shell 14', each engine being provided with an upper and lower spherical aligner of which only the adjacent lower aligners 50 are shown. A constricted shell region 118 between the lower spherical aligners 50 of the two engines connects the outer shell portions enveloping each of the two engines. The constricted shell region 118 defines a crankcase within which is disposed a crank-shaft arrangement including drive shaft 112 mounted at right angles to the longitudinal axis of the two engines and driven by the opposing work pistons 104 (only one piston being shown in FIG. 5*a*) through crank-arms 110. The drive shaft 112, as seen in FIG. 5*b* extends through the wall of the crank case 118 to the exterior of the shell 14' for coupling to an engine load. The particular engine and crank case arrangement in FIG. 5*a* is shown to illustrate the mechanical output shaft 112 extending through a low pressure shaft seal 106 in the wall of the shell 14' in the area of crank case 118 as shown in FIG. 5*b*. The crank case space communicates with the buffer spaces defined by the outer shell 14' around each of the two engines and is filled with working gas at the same low pressure as are these buffer spaces, i.e. at atmospheric or preferably slightly above atmospheric pressure. The pressure differential across the seal 106 can thus be kept very low, which greatly facilitates the sealing of the mechanical output shaft to the outer shell 14' as compared to the high pressure seals normally required in similar engines where no working gas filled low pressure buffer space is defined by an outer envelope 14'. It will be understood that while the examples shown in FIGS. 5*a*–5*d* show engine output shafts, the same low pressure shaft sealing principle is applicable to mechanical work input shafts for refrigerator machines.

FIG. 5*c* illustrates the same principle of a low pressure shaft seal 106' for sealing a linearly reciprocating mechanical output shaft 112' extending through a bottlenose extension 118' of an outer shell 14'' enclosing a thermal machine having a compound work piston 104' connected to the output shaft 112' by means of a universal joint 111. Again, only a low pressure dynamic seal 106' is required for sealing the internal space 115 in communication with a buffer space defined by the outer shell 14'' and filled with working gas at relatively low pressure.

FIG. 5*d* shows an arrangement similar to that of FIG. 5*c* where the dynamic seal 106' of FIG. 5*c* has been replaced by a bellows seal 117 attached between the wall of the outer shell 14'' and the output shaft 112' for sealing the working gas filled space 115. The space 119 on the opposite side of the bellows is vented to the outer atmosphere by an opening 121 in the outer shell 14''. The low pressure differential imposed across the bellows seal 117 makes for greater reliability and prolonged service life of the bellows structure.

FIG. 6 shows the work output end of a thermal engine particularly adapted for compressing a gas which is the same as the working gas in the engine. The engine is shown only in part, being of conventional construction as to portions not shown, including the usual displacer arrangement. The work piston 205 of the engine works against a gas spring 206 and is connected, by means of a linkage rod 207 extending through seal 208 in the bottom wall of the work piston cylinder to a compressor piston 210 reciprocating in compressor cylinder 211. The engine is enclosed within an outer shell 201 constructed in the manner already described, including a lower spherical aligner 202, it being understood that the engine includes an opposite upper spherical aligner at the thermal end not shown in the drawing. The outer shell 201 defines a buffer space 204 about the engine body 216 filled at low pressure with working gas used in the displacer chamber of the engine. This engine arrangement may advantageously be used as a compressor for compressing a gas produced at low pressure in an external gas generator 215 which generates gas similar to the working gas used in the engine and filling the buffer space 204. The gas generator 215 is connected through check valve 212 to the bottom of the compressor cylinder 211 and is also connected through check valve 213 to a high pressure gas storage tank 214. The top of the compressor cylinder 211 is vented through opening 209 to the engine buffer space 204. As the compressor piston 210 is reciprocated by the work piston 205, low pressure gas from the generator 215 is drawn into and compressed in cylinder 211 for charging the storage tank 214. The advantage of this arrangement is that no sealing is required between the compressor cylinder 211 and the atmosphere because of the intervening buffer space 204. Any leakage of compressed gas into the buffer space is harmless since the gas being compressed is the same as the working gas of the engine and no contamination of the same takes place. Likewise, no contamination of the gas compressed in cylinder 211 occurs since any leakage into the cylinder 211 is of similar gas from the buffer space and therefore it is possible to maintain a high degree of purity of the compressed gas.

FIG. 3 shows a thermal machine 310 having a machine body 312 enclosed in a hermetically sealed outer shell 14 and maintained in axial compression between an upper spherical aligner 48 and a lower spherical aligner 50 in a manner analogus to that of engine 12 in FIG. 1. Like elements in FIGS. 1 and 3 bear like numbering. The shell 14 of FIG. 3 is shown as a single shell without the outer filament winding 52 of FIG. 1. The machine 310 is configured as a refrigerator having a cold finger or refrigerator coil 326, such as an ammonia filled tube connected to cooling coil 328 wound around the cold end of the displacer chamber 24 in the cold head section 320 of the engine body 312.

The piston element **36*b* of the compound work piston 36 in FIG. 3 is driven hydraulically by a hydraulic work input circuit comprising upper and lower hydraulic lines 315 and 317 respectively connected to the hydraulic cylinder 40 on opposite sides of the hydraulic piston element 36*b*, a four-way hydraulic control valve 319, motor driven hydraulic pump 321 and hydraulic fluid reservoir 323. The four-way valve 319 is controlled by an output control signal derived from engine controller 60 so as to control the direction of hydraulic fluid flow through the lines 315, 317 as well as the instantaneous volume of such fluid flow to thereby maintain continuous positive control over the motion of the compound work piston 36. The engine body 312 in FIG. 3 is shown as consisting of two axial sections namely cold head section 320 retained to the remainder 322 of the body 312. The two engine body sections are maintained in axial compression to maintain a gas tight seal at their mating surfaces 321 by means of a static seal 58**.

Further distinctions between the FIG. 3 thermal machine and the embodiment of FIG. 1 include provision of an external motor driven gas pump 327 which draws working gas from the low pressure upper buffer space 76 defined in the engine body through conduit 329 and associated check valve, and compresses the gas for storage in high pressure annular storage space 72 through conduit 331. The external gas pump 327 and associated conduits 329, 331 replace part of the pumping arrangement associated with pump cylinder 80 in FIG. 1, and specifically eliminating the gas passages 86 and 88 in FIG. 1. The FIG. 3 machine retains passages 84 and 90 which cooperate with pump piston 80 for drawing low pressure working gas from the upper buffer space 76, and compressing the same into the displacer chamber 24 through conduit 90. The gas space 338 below piston element **36*a* has been opened to the upper buffer space by means of passage 339 so that pressure in space 338 is equalized with working gas pressure in the upper buffer space 76, as well as with lower buffer space 96*a* through pressure equalizing check valve 98**.

Figure 7:
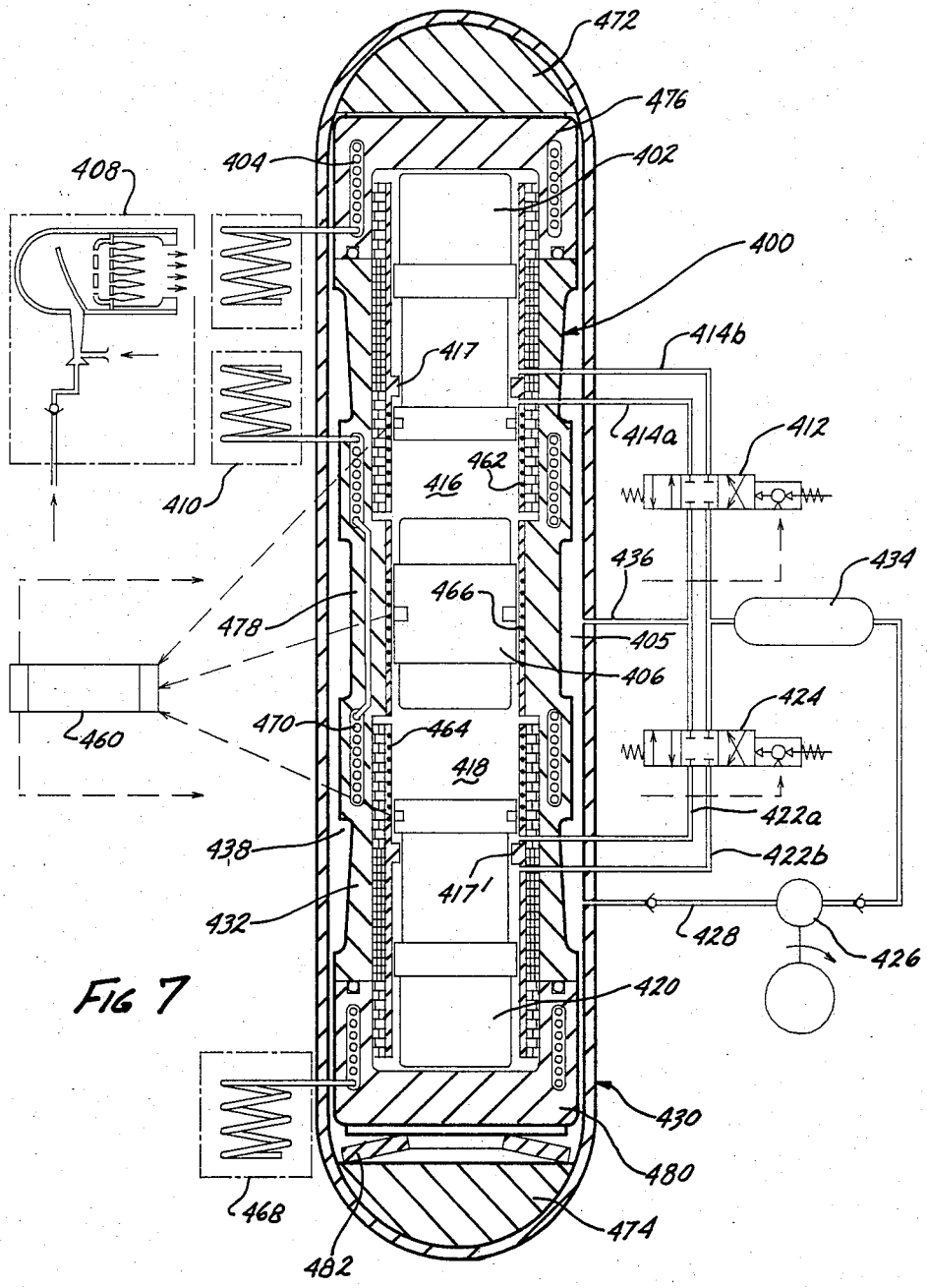
FIG. 7 is a longitudinal section of a thermal machine combining a Stirling cycle engine driving a Stirling cycle refrigerator enclosed in a common outer shell.

Turning now to FIG. 7, a sealed outer shell 430 is shown enveloping a Stirling cycle engine/refrigerator combination thermal machine 400 having a common free work piston 406. The upper portion of the thermal machine 400 is an engine having a displacer 402, a heating coil 404 powered by an external engine burner system 408, and a cooling coil system 410. The displacer 402 is reciprocated by means of a pneumatic control system including four-way pneumatic servo-valve 412 and pneumatic control lines **414*a* and 414*b* which apply a controlled pressure differential on either side of dynamic seal 417, as has been explained in connection with similar pneumatic displacer control systems in FIGS. 1–3. The cyclic variations in working fluid pressure in upper displacer chamber 416 drive the work piston 406 which in turn induces corresponding cyclic variations in working gas pressure in a lower displacer chamber 418, thereby producing cyclic variations in working gas temperature in the lower displacer chamber. The machine further comprises a refrigerating coil 468, and a heat sinking coil 470 on the "hot" side of the refrigerator displacer chamber 418 and which is connected to the cooling coil 410 of the engine side of the machine. A second displacer 420 associated with the lower refigerator section of the machine 400 is similarly pneumatically driven by a controlled pressure differential across seal 417' applied through pneumatic control lines 422*a* and 422*b* and a second four-way pneumatic control servo-valve 424. Pneumatic pressure is supplied by a motor driven pneumatic pump 426 external to the outer shell 430 enclosing the thermal machine and connected through conduit 428 for drawing working gas from the low pressure buffer space 405 defined between the machine body 432 and the wall of outer shell 430. The working gas compressed by pump 426 is stored at high pressure in pneumatic supply tank 434 which feeds the supply control lines 414*b* and 442*b* through the corresponding control servo-valves 412 and 424. The pair of return pneumatic control lines 414*a* and 422*a* are connected through their corresponding control valves 412 and 424 and through common return line 436 to the low pressure working gas filled buffer space 438. Each of the pneumatic control valves 412 and 424 controls the direction and magnitude of the pneumatic pressure differential across the two lines associated with each control servo-valve so as to maintain positive and independent control over the motion of each displacer 402, 420. The relative phase between the two displacers and the free work piston 406 is controlled by engine controller 460 which receives control inputs from piston sensors 462, 464, and 466 which provide position information to the engine controller for the upper displacer, lower displacer and work piston respectively. The engine controller derives output control signals based on said input information which output signals are connected for controlling the two four-way servo-valves 412, 424**, thus completing the servo-control loop.

In the FIG. 7 example the combined engine/refrigerator is enclosed in a single outer shell 430 having a cylindrical cross-section and closed at each end by hemispherical end sections. Upper and lower spherical aligners 472, 474 respectively are provided between the shell end sections and the upper and lower ends of the machine body 432 so as to maintain the machine body in axial compression, thereby maintaining various machine body sections such as an upper hot head section 476, intermediate body section 478 and lower cold end section 480 in axially compressed, gas sealing relationship as has been earlier described in connection with the various examples of FIGS. 1–3. The axially compressive force is provided by pre-loading spring 482 compressed between the lower end of the engine body and the lower hemispherical aligner 474, thus also maintaining the outer shell 430 in tension between its two ends.

A combination engine/refrigerator such as in FIG. 7 may be advantageously powered by a first source of waste heat for cooling a second source of waste heat, as for example in electronic system or computers which generate large amounts of heat, the first heat source being selected to be greater than the second heat source.

While particular embodiments of the invention have been described and illustrated for purposes of clarity, it will be understood that many modifications, substitutions, and alterations will become apparent to those possessed of ordinary skill in the art. It is therefore intended that the foregoing description be by way of example only and not as limitation of the scope of the invention which is defined only by the following claims.

What is claimed is:

1. In a thermal machine of the type including a machine body having a main axis extending between a thermal end and a work end, a working fluid at relatively high pressure in a working fluid chamber defined in said body and a displacer element reciprocable in said chamber for displacing the working fluid between a hot space and a cold space of said working fluid chamber for subjecting the fluid to a thermodynamic cycle in cooperation with a work piston, the improvement comprising outer shell means enclosing said machine body for maintaining at atmosphere of said working fluid about said machine body at a pressure substantially lower than in said working fluid chamber.

2. The improvement of claim 1 wherein said outer shell means are constructed, dimensioned and adapted for normally maintaining said machine body in axial compression between said ends.

3. The improvement of claim 2 wherein said outer shell means comprise an outer shell and pre-loading means cooperating with said outer shell for normally maintaining said machine body in axial compression.

4. The improvement of claim 3 wherein said pre-loading means comprise spring means interposed axially in compression between said machine body and said shell.

5. The improvement of claim 2 wherein said machine body comprises a plurality of machine body sections held in axially assembled relationship only by compressive force exerted thereon by said outer shell means.

6. The improvement of claim 5 wherein axially adjacent ones of said machine body sections are held in substantially gas-tight sealing relationship by said outer shell means.

7. The improvement of claim 1 wherein said outer shell means enclose a buffer space substantially greater than the volume of compressed working fluid in said machine body to allow for substantial decompression of explosively released gas in the event of structural failure of said machine body.

8. The improvement of claim 7 wherein said outer shell means also serves as a physical barrier against flying fragments of said machine body in case of such explosive failure.

9. The improvement of claim 5 further comprising aligner means interposed between said shell means and each of said machine ends for maintaining alignment of the compressive force exerted by said shell means upon said machine body with an outer shell axis.

10. The improvement of claim 9 wherein said outer shell is substantially a cylinder extending between two hemispherical ends and said aligner means are spherical aligners rotatably slidable within hemispherically concave shell end inner surfaces.

11. The improvement of claim 1 wherein said working fluid atmosphere about said machine body is at atmospheric or near atmospheric pressure.

12. The improvement of claim 1 further comprising gas pump means connected for drawing working fluid from said working fluid atmosphere and replenishing said working fluid chamber with pressurized working fluid to thereby make-up for leakage of working fluid from said chamber.

13. The improvement of claim 1 further comprising gas burner means for heating said hot space and burner gas supply means connected for supplying said gas burner means with working fluid drawn from said working fluid atmosphere.

14. The improvement of claim 1 wherein said work piston is driven by said working fluid for pumping a fluid in an output fluid chamber defined in said machine body near said work end, said improvement further comprising partition means dividing said buffer space into a clean buffer space associated with said thermal end and a contaminated buffer space in communication with said output fluid chamber, said clean buffer space being sealed against flow of gas from said contaminated buffer space.

15. The improvement of claim 14 further comprising gas pump means connected for compressing working gas from said clean buffer space and replenishing said working fluid chamber with said compressed gas.

16. The improvement of claim 14 further comprising gas burner means for heating said hot space and gas supply means for supplying working gas drawn from said contaminated buffer space for combustion in said burner means.

17. The improvement of claim 14 further comprising gas pump means connected for compressing working gas from said clean buffer space and replenishing said working fluid chamber with said compressed gas, gas burner means for heating said hot space, and gas supply means for supplying working gas drawn from said contaminated buffer space for combustion in said burner means.

18. The improvement of claim 1 further comprising pneumatic displacer control means for reciprocating said displacer element by applying a controlled gas pressure differential to said displacer element, said displacer control means including pump means connected for pressurizing working fluid drawn from said buffer space and supplying said displacer control means with said pressurized gas for applying said pressure differential.

19. The improvement of claim 2 wherein said outer shell is tubular and has two opposite closed ends, said machine body being supported between said opposite shell ends, and said pre-loading means comprise spring means compressed between one of said machine ends and one of said shell ends.

20. The improvement of claim 2 wherein said pre-loading means comprise pressurized bellows means.

21. The improvement of claim 1 further comprising mechanical shaft means connected to said work piston and extending through an opening in said outer shell means, and seal means between said shaft means and said outer shell means for sealing said buffer space against the exterior environment.

22. In a thermal machine of the type having a machine body with a main axis extending between a thermal end and a work end, said machine body being comprised of a plurality of axial body sections, a working fluid at relatively high pressure in a chamber defined in said body and a displacer element reciprocable in said chamber for displacing the working fluid between a hot space and a cold space of said chamber for subjecting the fluid to a thermodynamic cycle in cooperation with a work piston, the improvement comprising an outer shell extending between opposite shell ends, pre-loading means in axial compression between one of said machine ends and a shell end for urging the other machine end against the opposite shell end thereby to maintain said machine body in axial compression and said body sections in axially assembled relationship solely as a result of said compressive force, said outer shell being maintained in tension between said shell ends.

23. The improvement of claim 22 wherein at least one pair of axially adjacent machine body sections are held together in gas tight sealing relationship by compressive force exerted by said preloading means.

24. The improvement of claim 22 wherein said shell ends have spherically curved inner end surfaces and further comprising spherical aligner means interposed between each shell end and a corresponding machine body end, each spherical aligner being rotatably slidable against said spherically curved inner surface so as to compensate for axial misalignment of said machine body sections and thereby maintain said compressive loading in alignment with a shell axis and said shell in a state of pure tension.

25. The improvement or claim 24 wherein at least one pair of axially adjacent machine body sections are held together in gas tight sealing relationship by compressive force exerted by said preloading means.

26. The improvement of claim 25 further comprising seal ring means between adjacent machine body sections for making a gas tight seal therebetween.

27. The improvement of claim 25 wherein said machine body sections are made of material having dissimilar physical properties.

28. The improvement of claim 25 wherein said machine body sections include at least one section made of ceramic material and one section made of metal, said ceramic and metal sections being held together in axially adjacent relationship only by said compressive pre-loading.

29. The improvement of claim 1 wherein said work piston is reciprocable in a compressor cylinder in said machine body, said cylinder having two ends, one end of said cylinder being connected to a source of low pressure gas similar to the working fluid in said chamber, said cylinder also having an outlet to the exterior of said outer shell means for gas compressed in said compressor cylinder, the other end of said compressor cylinder being vented to said buffer space, whereby a gas similar to the working fluid in said chamber can be compressed in said cylinder without contamination of said buffer space through leakage from said compressor cylinder and eliminating the need for high pressure sealing between said compressor cylinder and the atmosphere outside said shell means.

30. The improvement of claim 13 further comprising working gas supply means connected to said outer shell for replenishing said buffer space with working gas to make-up for gas combusted in said burner.

31. The improvement of claim 1 further comprising support means between said machine body and said outer shell axially intermediate said thermal end and said work end for supporting said machine body against radial buckling under compressive loading.

32. In a thermal machine including a machine body defining first and second working fluid chambers, a displacer reciprocable in each said chamber for subjecting a working fluid to a thermodynamic cycle particular to each of said chambers in cooperation with a common work piston reciprocable between said displacers, the improvement comprising:

displacer drive means for independently reciprocating each of said displacers;

first, second and third position sensor means for deriving signals indicative of the position of said two displacers and said common work piston along their respective strokes in said machine body;

machine controller means receiving said position indicative signals and connected for controlling said displacer drive means responsively to said position indicative signals to thereby maintain independent control over the phase relationship of each said displacer to said said common work piston.

33. The improvement of claim 22 further comprising outer shell means enclosing said thermal machine body and containing an atmosphere of said working fluid about said machine body at a pressure substantially below the working fluid pressure in said displacer chambers, said displacer drive means including pneumatic drive means for applying a working gas pressure differential to each of said displacers and pump means for supplying said pneumatic drive means with compressed working fluid drawn from said atmosphere of working fluid.

* * * * *

UNITED STATES PATENT AND TRADEMARK OFFICE

CERTIFICATE OF CORRECTION

PATENT NO. : 4,638,633

DATED : January 27, 1987

INVENTOR(S) : John L. Otters

It is certified that error appears in the above—identified patent and that said Letters Patent is hereby corrected as shown below:

Abstract, line 4:
Delete "thereby simplifying" and substitute therefor --thereby simplify--.

Column 1, line 31:
Delete "cae" and substitute therefor --case--.

Column 4, line 7:
Delete "sheel" and substitute therefor --shell--.

Column 7, line 40:
Delete "followed" and substitute therefor --following--.

Claim 1, Column 15, line 18:
Delete "at atmosphere" and substitute therefor --an atmosphere--.

Claim 25, Column 17, line 20:
Delete "or claim" and substitute therefor --of claim--.

Claim 32, Column 18, line 33:
Delete "said said" and substitute therefor --said--.

Claim 33, Column 18, line 34:
Delete "claim 22" and subsitute therefor --claim 32--.

UNITED STATES PATENT AND TRADEMARK OFFICE

CERTIFICATE OF CORRECTION

PATENT NO. : 4,638,633

DATED : January 27, 1987

INVENTOR(S) : John L. Otters

It is certified that error appears in the above—identified patent and that said Letters Patent is hereby corrected as shown below:

Figure 2 drawing, Item 92 is not called out. (Hydraulic vent passage to buffer space)

Column 10, line 50:
Delete "transfered" and substitute therefor --transferred--.

Column 10, line 65:
Delete "section" and substitute therefor --sections--.

Column 12, line 10:
Delete "shaft 112'" and substitute therefor --shaft 112--.

Column 12, line 28:
Delete "same as" and substitute therefor --same kind as--.

Column 13, line 3:
Delete "shell 14" and substitute therefor --shell 314--.

Column 13, line 7:
Delete "shell 14" and substitute therefor --shell 314--.

Signed and Sealed this

First Day of September, 1987

*Attest:*

*Attesting Officer*

DONALD J. QUIGG

*Commissioner of Patents and Trademarks*